United States Patent [19]

Rand

[11] Patent Number: 4,621,213

[45] Date of Patent: Nov. 4, 1986

[54] ELECTRON GUN

[75] Inventor: Roy E. Rand, Palo Alto, Calif.

[73] Assignee: Imatron, Inc., South San Francisco, Calif.

[21] Appl. No.: 626,996

[22] Filed: Jul. 2, 1984

[51] Int. Cl.[4] ..... H01J 1/00

[52] U.S. Cl. ..... 313/237; 313/238

[58] Field of Search ..... 313/237, 238

[56] References Cited

U.S. PATENT DOCUMENTS 2,391,780 12/1945 Hillier ..... 313/237

3,109,953 11/1963 Burnett ..... 313/237

*Primary Examiner*—Harold Dixon

*Attorney, Agent, or Firm*—Flehr, Hohbach, Test, Albritton & Herbert

[57] ABSTRACT

An electron gun which can be easily disassembled to replace a defective cathode assembly and which can be easily and quickly reassembled and realigned.

5 Claims, 8 Drawing Figures

ELECTRON GUN

This invention relates generally to an electron gun and more particularly to an electron gun which can be easily disassembled to replace a defective cathode assembly and which can be quickly and easily realigned during reassembly.

In U.S. Pat. No. 4,352,021, there is described a high speed, multiple section computer-tomographic X-ray scanner. The scanner utilizes an electron gun which provides an electron beam which is scanned along targets to provide a fan shaped X-ray beam which scans body sections. The scanner is used to provide tomographic images of the body, particularly the heart. In such scanning systems, it is desirable to minimize maintenance costs and down-time to scan more patients and reduce cost per scan. Thus, component parts, including the electron gun, must be capable of rapid repair and/or replacement. The cathode in electron guns is generally the part which fails.

In prior art electron guns have been used in linear accelerators and in electron tubes such as Klystrons, reflux Klystrons and traveling wave tubes. In many of these applications there has been no need for replacement of the cathode because the total cost of the gun assembly has been relatively low. In linear accelerators the cathode assemblies of the electron gun have been replaced. The usual method has been to cut the ceramic-to-metal seals to provide access to the cathode. Reassembly and realignment have been time consuming and expensive.

It is a general object of the present invention to provide an improved electron gun.

It is another object of the present invention to provide an electron gun in which the cathode assembly can be easily replaced.

It is a further object of the present invention to provide an electron gun which can be easily disassembled for replacement of the cathode assembly and which can be easily aligned and reassembled.

It is still another object of the present invention to provide an electron gun in which the cathode and focusing electrodes can be pre-assembled and aligned.

An electron gun of the present invention comprises a base, a cathode assembly support, a cathode assembly removably mounted on said support, means for adjustably mounting a focusing electrode assembly to said cathode assembly support whereby the focusing electrode assembly can be pre-aligned with respect to said cathode assembly, means for mounting said pre-aligned focusing electrode and cathode support to said base whereby they can be aligned, means including an insulator for mounting an anode on said base spaced from said cathode in alignment with the focusing electrode, said base, insulator and anode support defining an envelope enclosing said cathode, focusing electrode and anode.

The foregoing and other objects of the invention may be more clearly understood from the following description taken in conjunction with the accompanying drawings which are illustrative thereof.

Figure 1:
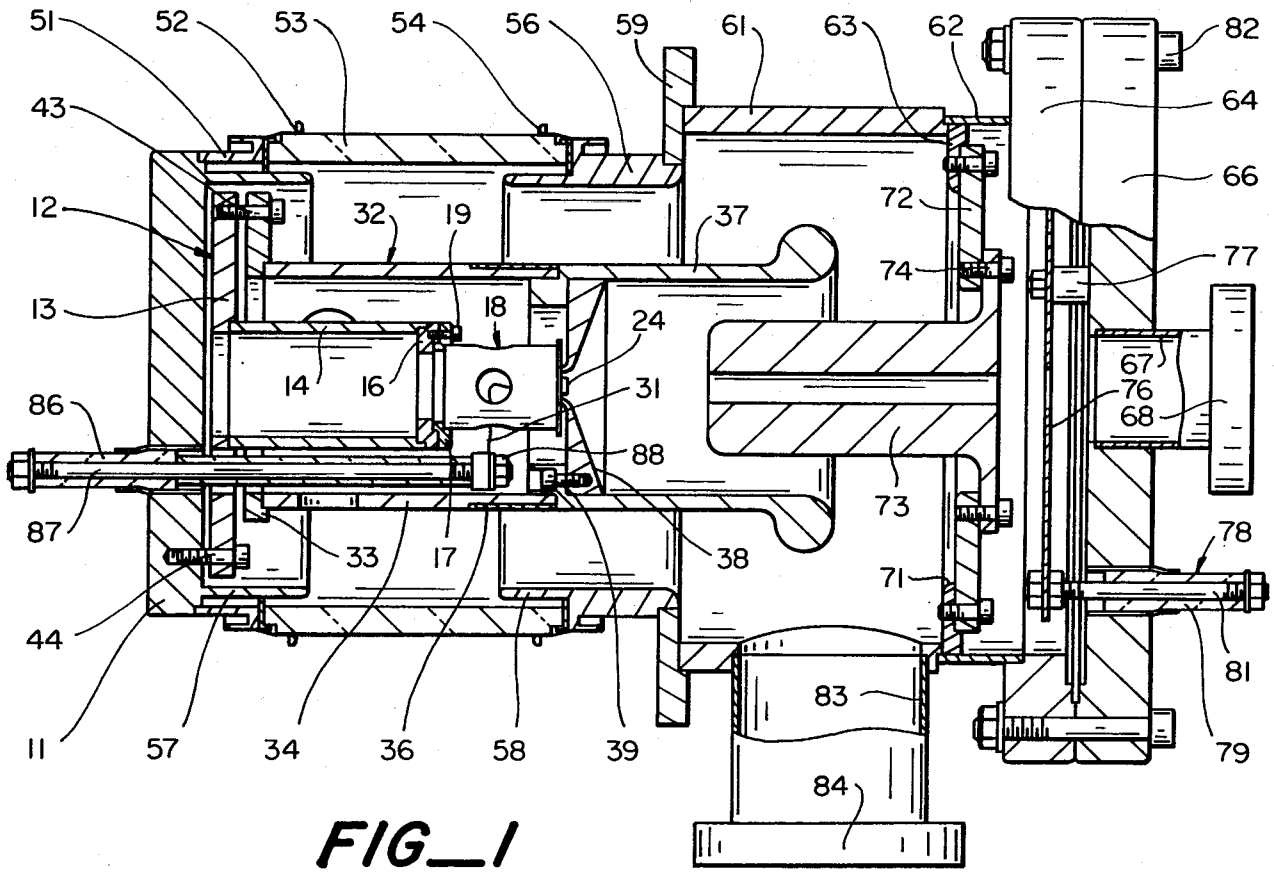
FIG. 1 is a partial elevational sectional view of an electron gun in accordance with the present invention.
Figure 2:
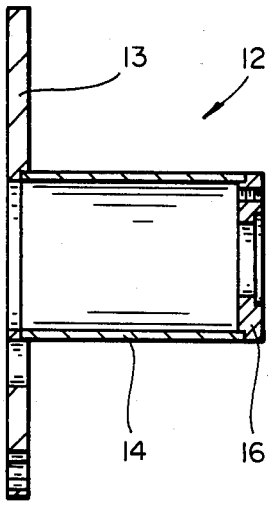
FIG. 2 is a sectional elevational view of the cathode assembly support in the electron gun of FIG. 1.
Figure 3:
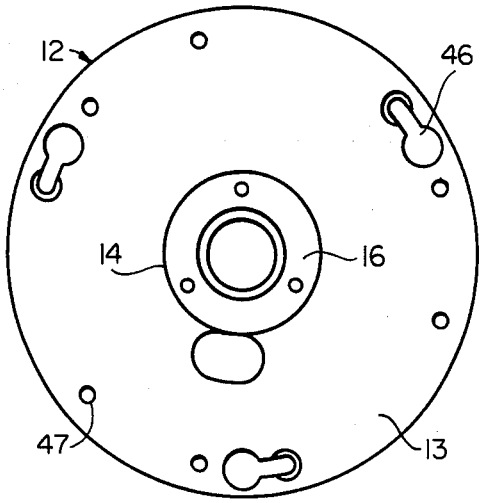
FIG. 3 is a front view of the cathode assembly support of FIG. 2.
Figure 4:
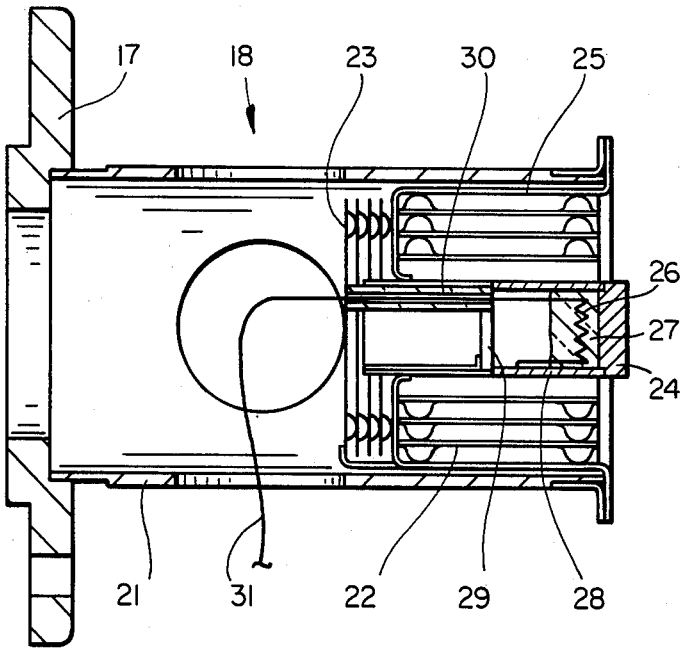
FIG. 4 is a sectional elevational view of the cathode assembly in the electron gun of FIG. 1.

Referring to the gun assembly of FIG. 1, it includes an end cap or base 11 which serves to support the cathode assembly support 12, FIGS. 1, 2 and 3, comprising a base plate 13, cylindrical support 14 brazed to the plate, and an end cap 16 brazed to the cylindrical support 14. The end cap 16 receives the flange 17 of the cathode assembly 18. The flange 17 is secured to the plate 16 by means of spaced screws 19. Referring particularly to FIG. 4, the cathode assembly includes a cylindrical shield 21 which supports a plurality of concentric cylindrical heat insulating shields 22 and disc shaped end insulating shields 23. An indirectly heated cathode button 24 is also supported by the shield 21 via cathode cup 25. A heater 26 is placed closely adjacent to the cathode button and potted in ceramic 27 within a cavity defined by the button 24, cylindrical member 28 and end shield 29. An insulated sleeve 30 accomodates the lead 31 to the heater 26 while the other end of the heater is grounded to the cylindrical member 28 of the heater cavity.

Figure 5:
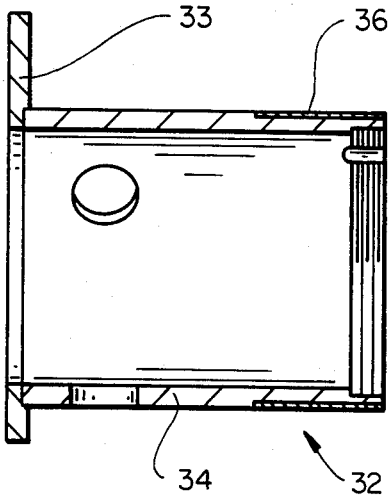
FIG. 5 is a sectional elevational view of the focusing electrode support in the electron gun of FIG. 1.
Figure 6:
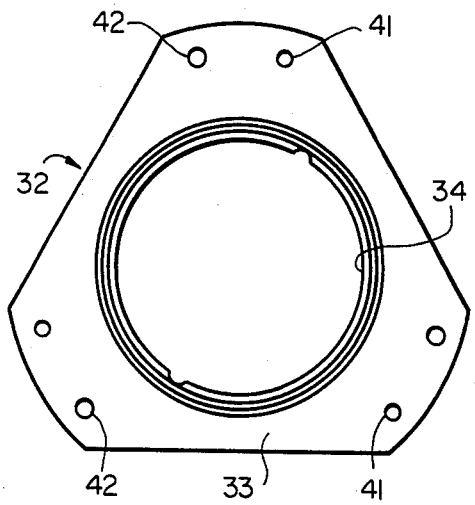
FIG. 6 is a front view of the focusing electrode support of FIG. 5.
Figure 7:
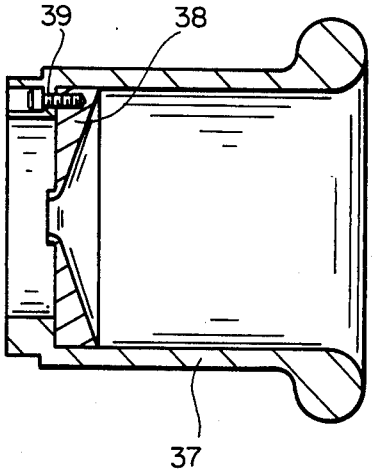
FIG. 7 is a sectional elevational view of the focusing electrode assembly in the electron gun of FIG. 1.
Figure 8:
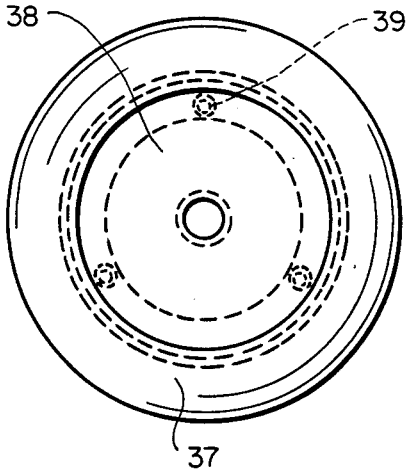
FIG. 8 is a front view of the focusing electrode assembly of FIG. 7.

A focusing electrode support 32, FIGS. 1, 5 and 6, is mounted on the base 13 of the cathode assembly support. The focusing electrode support includes a base plate 33 and a cylindrical member 34 brazed thereto. Preferably, the base is formed of stainless steel and the cylindrical member is formed of copper. To minimize expansion a stainless steel sleeve 36 is suitably affixed to the end of the cylindrical member. The focusing electrode support threadably receives focusing electrode 37. The focusing electrode receives a Pierce electrode 38 which is secured thereto by screws 39 and which incircles and is closely spaced from the cathode button 24.

In assembly of the electron gun the focusing electrode support is aligned with the cathode assembly support by the use of six screws, three 41 of which are threadably received by the plate 33, FIG. 6, and three which pass through the holes 42 and are threadably received by the plate 13 such as shown at 43, FIG. 1. Thus, by suitably tightening and loosening the screws, the cylindrical focusing electrode support including the electrode assembly can be coaxially aligned with the cathode assembly. The pre-assembled cathode assembly support, cathode assembly and focusing electrode support can then be mounted upon the end cap or base 11. This is accomplished by having three screws 44 threaded into the end cap or base 11, inserting the preassembled assembly with the enlarged openings in the keyholes 46, FIG. 3, sliding over the heads, and then rotating the assembly. Thereafter, screws are threaded into the openings 47 until they abut the end plate to thereby provide for alignment of the complete assembly within the outer envelope as will be presently described.

The outer envelope includes a ring 51 brazed to the end cap or base 11 which has brazed thereto a Kovar seal 52. A cylindrical ceramic insulator 53 is brazed to the seal 52. The other end of the insulator is brazed to a seal 54 brazed to the cylindrical member 56. The end cap 11 and cylindrical member 56 includes inwardly extending skirts 57 and 58 which form corona shields. A flange 59 is brazed to the member 56. A cylindrical member 61 is brazed to the flange to a thin cylindrical member 62 and to an anode support 63 at the other end. Member 62 is suitably brazed to a flange 64 which cooperates with flange 66 which includes cylindrical envelope 67 and flange 68 for mounting the electron gun to an associated scanner.

Assembly and alignment of the electron gun are relatively simple. After the cathode assembly and focusing electrode support together with the electrode assembly 37, 38 have been bench aligned, the focusing electrode is unscrewed from the support and the subassembly secured to the base 11. Filament lead 31 is connected to feed-through by nut 88 and electrode is re-threaded into support. Electrical connection is made to the cathode lead 31 by means of a feed-through comprising the ceramic support 86 and lead-through 87 which extends into the envelope and adjacent the cathode assembly whereby the lead 31 may be secured to the lead-through by means of the nut 88. The assembly is aligned by adjusting the screws 44 and those extending through the openings 47, FIG. 3. A jig or fixture may be employed to provide the proper alignment of the focusing electrode with respect to the opening 71 in the member 63. This adjustment can be easily made since the anode assembly is not in place and a tool can be extended into the envelope to engage the screws or bolts. Thereafter, ring 72 is suitably secured by bolts to the ring 63 and the anode 73 is secured to the ring 72 by means of screws 74.

The flange 66 carries an ion trap 76 which is mounted thereon by insulators 77 and feed-through 78 which comprises a conductive bolt 81 supported in the ceramic member 79 suitably sealed to the flange 66. The bolts 82 are then secured to provide the complete electron gun assembly and to form the evacuated envelope containing the cathode, focusing electrode and anode.

A suitable vacuum outlet tube 83 is secured to the cylindrical envelope portion 61 and includes a flange 84 whereby it can be connected to an associated vacuum pumping system to evacuate the interior of the electron gun.

The cathode and focusing electrode are insulated from the anode by the ceramic envelope portion 53 whereby the anode may be placed, for example, at ground potential while the cathode and associated focusing electrode may be placed at a high negative voltage, for example, at −130 KV. A suitable dc or ac voltage can be applied to the heater as, for example, 6 volts to thereby indirectly heat the impregnated cathode and cause excitation of electrons.

Under the influence of the electric fields between the anode and the associated focusing electrode and cathode button, the electrons escape from the surface and flow as a stream. By suitably configuration the Pierce electrode, the electrons are caused to flow from the cathode button in a laminar beam through the anode and project into the associated scanner. The ion trap is maintained at a voltage as, for example, −400 volts, to trap positive ions whereby they do not impinge upon the cathode button 24.

Should the cathode assembly burn out or otherwise become inoperative, it can be easily replaced by removing the flange 66, the anode 73, flange 72 and the focusing electrode 37. The bolts or screws 44 and the nut 88 are loosened to remove the cathode and electrode assemblies. The cathode assembly is replaced, pre-aligned and reinserted in the envelope. The assembly can then be aligned in the envelope by means of jigs or fixtures. The anode and its supports and flange 66 are then replaced.

Thus, it is seen that there has been provided an electron gun which is relatively easy to disassemble for replacement of the cathode assembly and can be easily reassembled and aligned.

What is claimed is:

1. An electron gun comprising a base, a cathode assembly support, a cathode assembly removably mounted on said cathode assembly support, a focusing electrode assembly, means for adjustably mounting said focusing electrode assembly to said cathode assembly support whereby the focusing electrode assembly can be pre-aligned to said cathode assembly, means for mounting said pre-aligned focusing electrode assembly and cathode support to said base whereby they can be aligned, means for mounting an anode spaced from said cathode assembly, and an insulator serving to support said anode mounting means from said base in alignment with the focusing electrode, said base, insulator and anode mounting means defining a portion of an evacuated envelope enveloping said cathode, focusing electrode and anode.

2. An electron gun as in claim 1 in which said focusing electrode assembly includes a focusing electrode support mounted to said cathode support and a focusing electrode threadably mounted to said focusing electrode support.

3. An electron gun comprising a base, a cathode assembly support, a cathode assembly removably mounted on said cathode assembly support, a focusing electrode assembly including a focusing electrode support mounted to said cathode assembly, a focusing electrode threadably mounted to said focusing electrode support and means on said focusing electrode support for minimizing expansion at the region where the focusing electrode is threadably mounted, means for adjustably mounting said focusing electrode assembly to said cathode assembly support whereby the focusing electrode assembly can be pre-aligned to said cathode assembly, means for mounting said pre-aligned focusing electrode assembly and cathode support to said base whereby they can be aligned, means for mounting an anode spaced from said cathode assembly, and an insulator serving to support said anode mounting means from said base in alignment with the focusing electrode, said base, insulator and anode mounting means defining a portion of an evacuated enveloped enveloping said cathode, focusing electrode and anode.

4. An electron gun comprising a base, a cathode assembly support, a cathode assembly removably mounted on said cathode assembly support, means for adjustably mounting said focusing electrode assembly to said cathode assembly support whereby the focusing electrode assembly can be pre-aligned to said cathode assembly, means for mounting said pre-aligned focusing electrode assembly and cathode support to said base whereby they can be aligned, means for mounting an anode spaced from said cathode assembly, an insulator serving to support said anode mounting means from said base in alignment with the focusing electrode, said base, insulator and anode mounting means defining a portion of an evacuated envelope enveloping said cathode, focusing electrode and anode, an ion trap electrode and means for mounting said ion trap electrode adjacent said anode.

5. An electron gun comprising a base, a cathode assembly support, a cathode assembly removably mounted on said cathode assembly support, a focusing electrode assembly, a Pierce electrode mounted on said focusing electrode assembly, means for adjustably mounting said focusing electrode assembly to said cathode assembly support whereby the focusing electrode assembly can be pre-aligned to said cathode assembly, means for mounting said pre-aligned focusing electrode assembly and cathode support to said base whereby they can be aligned, means for mounting an anode spaced from said cathode assembly, and an insulator serving to support said anode mounting means from said base in alignment with the focusing electrode, said base, insulator and anode mounting means defining a portion of an evacuated envelope enveloping said cathode, focusing electrode and anode.

* * * * *